US009607814B2

(12) United States Patent
Kurouzu

(10) Patent No.: US 9,607,814 B2
(45) Date of Patent: Mar. 28, 2017

(54) PHOTODETECTION UNIT AND METHOD FOR MANUFACTURING SAME

(71) Applicant: HAMAMATSU PHOTONICS K.K., Hamamatsu-shi, Shizuoka (JP)

(72) Inventor: Takanori Kurouzu, Hamamatsu (JP)

(73) Assignee: HAMAMATSU PHOTONICS K.K., Hamamatsu-shi, Shizuoka (JP)

( * ) Notice: Subject to any disclaimer, the term of this patent is extended or adjusted under 35 U.S.C. 154(b) by 148 days.

(21) Appl. No.: 14/437,983

(22) PCT Filed: Aug. 19, 2013

(86) PCT No.: PCT/JP2013/072102
§ 371 (c)(1),
(2) Date: Apr. 23, 2015

(87) PCT Pub. No.: WO2014/069073
PCT Pub. Date: May 8, 2014

(65) Prior Publication Data

US 2015/0311049 A1 Oct. 29, 2015

(30) Foreign Application Priority Data

Oct. 30, 2012 (JP) ..... 2012-238992

(51) Int. Cl.
*H01J 43/28* (2006.01)
*H01J 43/30* (2006.01)
(Continued)

(52) U.S. Cl.
CPC ..... *H01J 43/28* (2013.01); *H01J 9/26* (2013.01); *H01J 43/18* (2013.01); *H01J 43/30* (2013.01)

(58) Field of Classification Search
CPC .. H01J 43/28; H01J 43/18; H01J 43/30; H01J 9/26; H01J 43/246; H01J 43/04;
(Continued)

(56) References Cited

U.S. PATENT DOCUMENTS 5,264,693 A 11/1993 Shimabukuro et al.
5,453,609 A * 9/1995 Gomez ..... H01J 43/246 250/207
(Continued)

FOREIGN PATENT DOCUMENTS

CN 202003946 10/2011
CN 102468109 5/2012
(Continued)

*Primary Examiner* — Anne Hines
*Assistant Examiner* — Jose M Diaz
(74) *Attorney, Agent, or Firm* — Drinker Biddle & Reath LLP

(57) ABSTRACT

In a photodetection unit 100 according to one aspect of the present invention, a photomultiplier 1 and a voltage divider board 132 are electrically connected to each other through a flexible wiring board 120, whereby the photomultiplier 1 can freely set its orientation and achieve a high degree of freedom of installation. In addition, in a voltage divider 130, an insulating resin 136 within a resin case 134 covers around the voltage divider board 132, thereby improving a voltage withstand performance of the voltage divider board 132. This eases restrictions on conditions under which the voltage divider board 132 is installed, whereby the degree of freedom of installation of the photodetection unit 100 is further improved as a whole, which makes it applicable to wider uses.

6 Claims, 5 Drawing Sheets

(51) Int. Cl.
*H01J 9/26* (2006.01)
*H01J 43/18* (2006.01)

(58) Field of Classification Search
CPC ..... H01J 43/20; H01J 43/22; H01J 43/243; G01T 1/248; G01S 3/781; G01S 3/782; G01S 3/784; G01S 5/163; H01L 27/00; H01L 27/016; H01L 27/0203; H01L 27/10844; H01L 27/10897
See application file for complete search history.

(56) References Cited

U.S. PATENT DOCUMENTS

| | | | | |
|---|---|---|---|---|
| 6,852,979 | B1 * | 2/2005 | Kyushima | H01J 43/28 250/366 |
| 2008/0291454 | A1 * | 11/2008 | Cai | G01N 21/8851 356/445 |

FOREIGN PATENT DOCUMENTS

| | | | |
|---|---|---|---|
| JP | H06-224314 | A | 8/1994 |
| JP | 2004-031682 | A | 1/2004 |
| JP | 2004-055848 | | 2/2004 |
| JP | 2010-267414 | A | 11/2010 |
| JP | 2011-187454 | A | 9/2011 |
| JP | 2012-204262 | A | 10/2012 |

* cited by examiner

PHOTODETECTION UNIT AND METHOD FOR MANUFACTURING SAME

TECHNICAL FIELD

The present invention relates to a photodetection unit including a planar photomultiplier for detecting incident light from the outside and a method for manufacturing the same.

BACKGROUND ART

Small photomultipliers continue to be developed by utilizing fine processing techniques. A known example is a planar photomultiplier in which a photoelectric surface, a dynode, and an anode are arranged on a light-transmissive insulating substrate (see Patent Literature 1). Such a structure makes it possible to detect weak light and reduces the size of the device.

CITATION LIST

Patent Literature

Patent Literature 1: U.S. Pat. No. 5,264,693

Patent Literature 2: Japanese Patent Application Laid-Open No. 2004-31682

SUMMARY OF INVENTION

Technical Problem

The above-mentioned conventional planar photomultipliers are assumed to be formed on a chip with a voltage divider where a high voltage is applied. However, the voltage divider is a heat generator and thus is preferably separated from the photomultiplier in order to prevent its heat from affecting the photomultiplier. Especially, the planar photomultipliers are more likely to be affected by the heat because structure susceptible to high temperature, such as the photoelectric surface, is located close to the planar parts of the planar photomultipliers.

Therefore, the inventors conducted studies about a photodetection unit in which a voltage divider and a photomultiplier are separate from each other while the voltage divider and the photomultiplier are electrically connected to each other. This has resulted in a technique which connects the voltage divider and the photomultiplier to each other through a flexible wiring board.

Such a photodetection unit can freely set the orientation of the photomultiplier because of the flexibility of the flexible wiring board and thus can achieve a high degree of freedom of installation of the photomultiplier. As a result of diligent studies, the inventors have achieved a technique for further improving the degree of freedom of installation of the photodetection unit.

That is, it is an object of the present invention to provide a photodetection unit including a photomultiplier with an improved degree of freedom of installation and a method for manufacturing the same.

Solution to Problem

The photodetection unit according to one aspect of the present invention comprises a planar photomultiplier having an electron multiplier with a plurality of stages, a voltage divider board for generating voltages to be supplied to the respective stages of the electron multiplier, and a flexible wiring board having one end part electrically connected to the photomultiplier and the other end part electrically connected to the voltage divider board; the photodetection unit further comprising a resin case for containing the voltage divider board and an insulating resin for covering around the voltage divider board within the resin case.

This photodetection unit, in which the planar photomultiplier and the voltage divider board are electrically connected to each other through the flexible wiring board, can freely set the orientation of the photomultiplier and thus has a high degree of freedom of installation of the photomultiplier. In addition, the voltage divider board is contained in the resin case and covered with the insulating resin around within the resin case, whereby the voltage withstand performance of the voltage divider board is improved. This eases restrictions on conditions under which the voltage divider board is installed, whereby the degree of freedom of installation of the photodetection unit is further improved as a whole, which makes it applicable to wider uses.

Within the resin case, a space between the resin case and the voltage divider board may be filled with the insulating resin. This prevents the voltage divider board from coming into contact with the resin case, whereby a higher voltage withstand performance can be achieved.

In the flexible wiring board, a boundary part between a part in contact with the voltage divider board and a part separated from the voltage divider board may be covered with the insulating resin. In this case, a bending stress in the boundary part of the flexible wiring board is more mitigated by the insulating resin, whereby the breaking of wires in the boundary part is prevented.

The resin case may have an opening for passing the flexible wiring board therethrough, the insulating resin within the resin case covering the flexible wiring board at the opening. This prevents the flexible wiring board from coming into contact with the resin case, thereby preventing the breaking of wires under the contact stress caused by the flexible wiring board coming into contact with the resin case.

The voltage divider board may include a capacitor. The insulating resin covering around the voltage divider board absorbs vibration and thus prevents vibration from deteriorating the function of the capacitor included in the voltage divider board.

The method for manufacturing a photodetection unit according to one aspect of the present invention is a method for manufacturing a photodetection unit comprising a planar photomultiplier having an electron multiplier with a plurality of stages and a voltage divider board for generating voltages to be supplied to the respective stages of the electron multiplier, the method comprising the steps of electrically connecting the photomultiplier to one end part of a flexible wiring board; electrically connecting the voltage divider board to the other end part of the flexible wiring board; containing the voltage divider board electrically connected to the flexible wiring board in a resin case and covering the voltage divider board with an uncured insulating resin within the resin case; and curing the uncured insulating resin within the resin case.

This method for manufacturing a photodetection unit produces a photodetection unit in which the planar photomultiplier having an electron multiplier with a plurality of stages and the voltage divider board are electrically connected to each other through the flexible wiring board. Such a photodetection unit can freely set the orientation of the photomultiplier and thus has a high degree of freedom of installation of the photomultiplier. In addition, the steps of covering the voltage divider board with an uncured insulating resin within the resin case and curing the uncured insulating resin within the resin case cover around the voltage divider board with the insulating resin within the resin case, whereby the voltage withstand performance of the voltage divider board is improved. This eases restrictions on conditions under which the voltage divider board is installed, whereby the degree of freedom of installation of the photodetection unit is further improved as a whole, which makes it applicable to wider uses.

Advantageous Effects of Invention

The present invention provides a photodetection unit including a photomultiplier with an improved degree of freedom of installation and a method for manufacturing the same.

DESCRIPTION OF EMBODIMENTS

Figure 1:
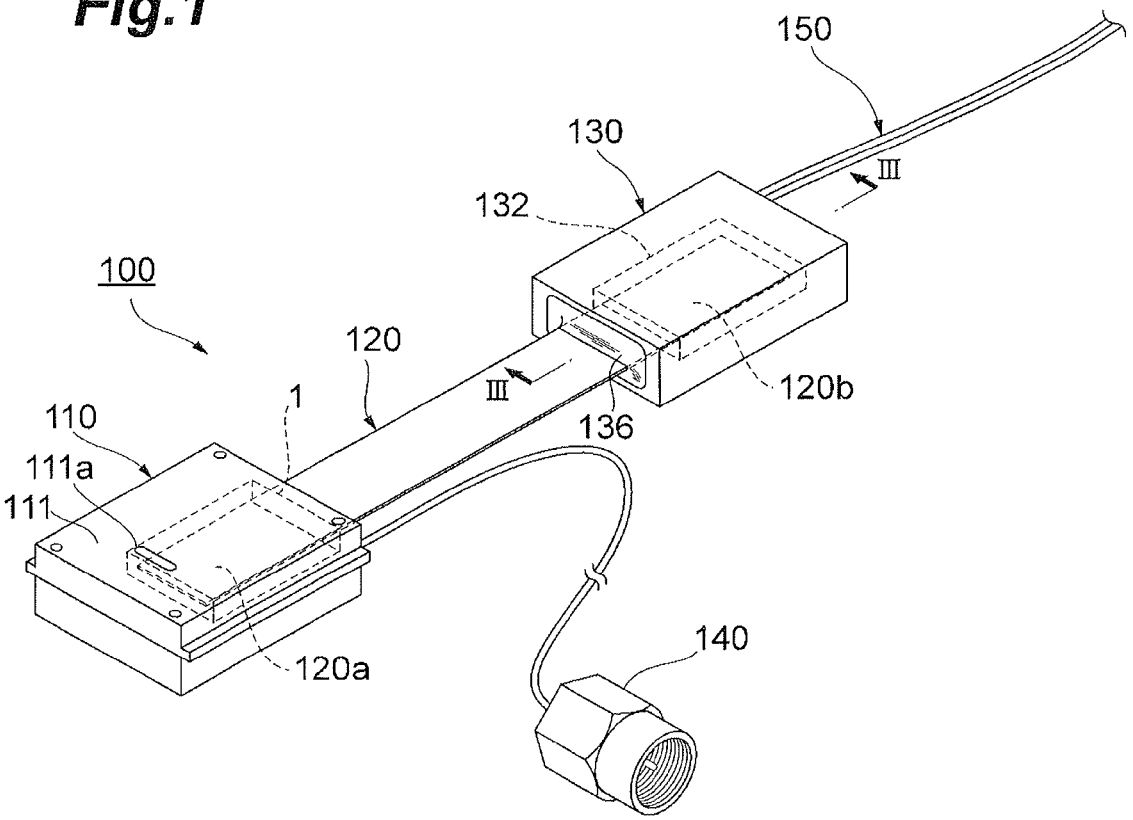
FIG. 1 is a schematic perspective view illustrating the photodetection unit according to an embodiment of the present invention.

In the following, preferred embodiments of the present invention will be explained in detail with reference to the accompanying drawings. In the drawings, the same constituents or those having the same functions will be referred to with the same signs while omitting their overlapping descriptions.

A photodetection unit 100 according to an embodiment of the present invention will be explained with reference to FIG. 1.

As illustrated in FIG. 1, the photodetection unit 100 comprises a photodetection part 110 including a photomultiplier 1 which will be explained later, an elongated planar flexible wiring board 120, and a voltage divider 130 including a voltage divider board 132 which will be explained later.

First, the photomultiplier 1 of the photodetection part 110 will be explained with reference to FIG. 2.

The photomultiplier 1, which is a planar photomultiplier having a transmissive photoelectric surface, comprises a housing 5 which is an enclosure constituted by an upper frame (second substrate) 2, a side wall frame 3, and a lower frame (first substrate) 4 opposing the upper frame 2 through the side wall frame 3. The photomultiplier 1 is an electron tube in which the direction of light incident on the photoelectric surface and the direction of multiplying electrons in an electron multiplier intersect. That is, the photomultiplier 1 is such an electron tube that, when light is incident thereon in a direction intersecting the plane constructed by the lower frame 4, photoelectrons released from the photoelectric surface impinge on the electron multiplier, secondary electrons are amplified in a cascading fashion in directions within the plane constructed by the lower frame 4, and a signal is taken out from an anode part.

In the following explanation, the upstream side (photoelectric surface side) and downstream side (anode part side) of the electron multiplication path (electron multiplication channel) along the electron multiplication direction will be referred to as "one end side" and "the other end side," respectively. Individual constituents of the photomultiplier 1 will now be explained in detail.

Figure 2:
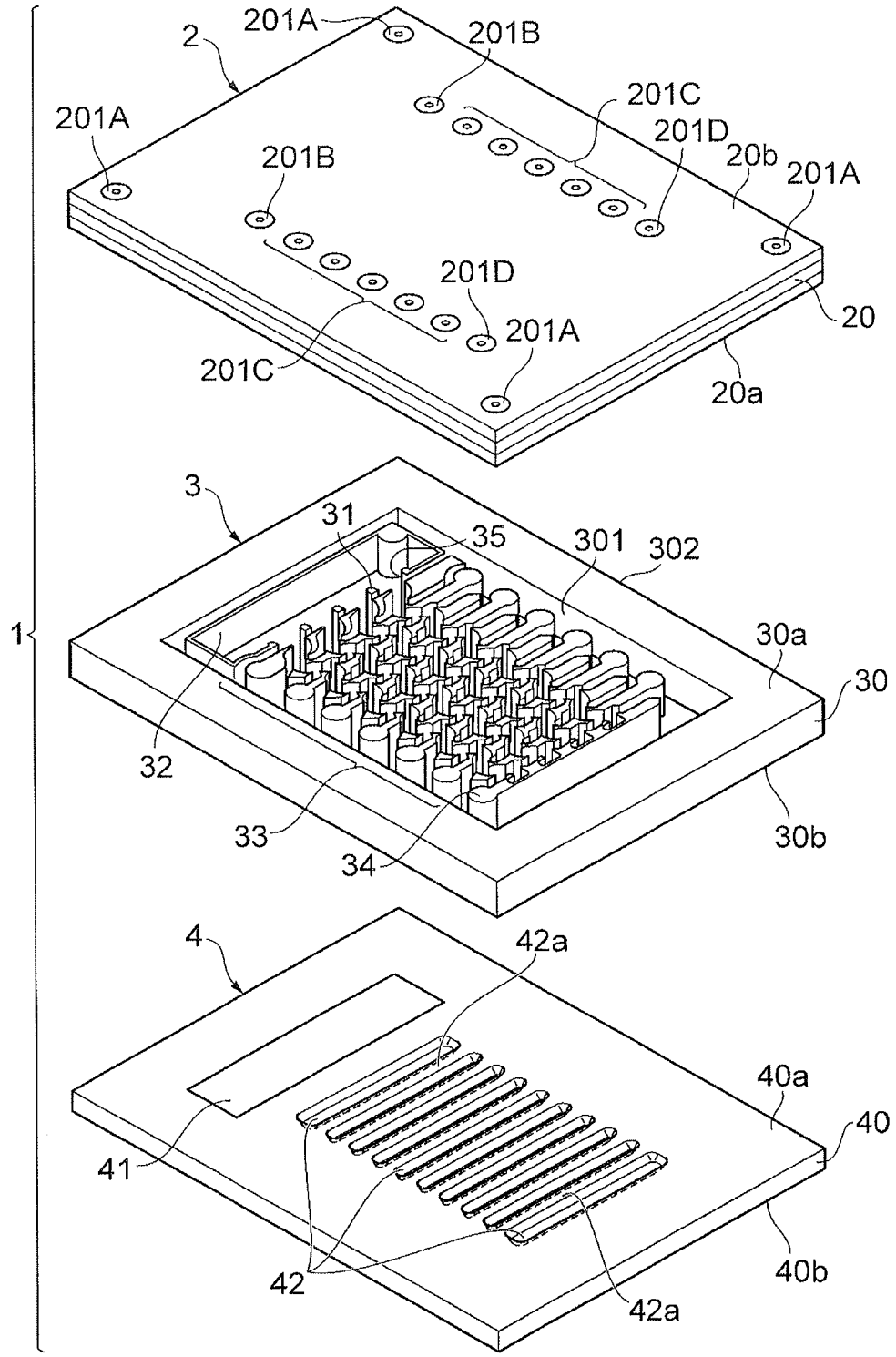
FIG. 2 is an exploded perspective view illustrating a photomultiplier included in a photodetection part of the photodetection unit of FIG. 1.

As illustrated in FIG. 2, the upper frame 2 is constructed from a rectangular planar wiring board 20 mainly composed of an insulating ceramic serving as a base. As such a wiring board, a multilayer wiring board using LTCC (Low Temperature Co-fired Ceramics) which enables fine wiring designs and makes it possible to design upper and lower wiring patterns freely and the like is employed. In the wiring board 20, a plurality of conductive terminals 201A to 201D which are electrically connected to the side wall frame 3 and a photoelectric surface 41, a focusing electrode 31, a wall electrode 32, an electron multiplier 33, and an anode part 34 on the principal surface 20*b*, which will be explained later, so as to feed power from the outside and take out signals. The conductive terminals 201A are provided for feeding power to the side wall frame 3; the conductive terminals 201B for feeding power to the photoelectric surface 41, focusing electrode 31, and wall electrode 32; the conductive terminals 201C for feeding power to the electron multiplier 33; and the conductive terminals 201D for feeding power to the anode part 34 and taking out signals. These conductive terminals 201A to 201D are mutually connected to conductive films and conductive terminals on an insulating opposite surface 20*a* opposing the principal surface 20*b* within the wiring board 20, whereby the conductive films and conductive terminals are connected to the side wall frame 3, photoelectric surface 41, focusing electrode 31, wall electrode 32, electron multiplier 33, and anode part 34. The upper frame 2 is not limited to the multilayer wiring board provided with the conductive terminals 201, but may be a planar member made of an insulating material such as a glass substrate through which conductive terminals for feeding power from the outside and taking out signals penetrate.

The side wall frame 3 is constructed from a rectangular planar silicon substrate 30 serving as a base. A through-hole part 301 surrounded by a frame-shaped side wall part 302 is formed so as to be directed from the principal surface 30*a* of the silicon substrate 30 to its opposing surface 30*b*. The through-hole part 301 has a rectangular opening and an outer periphery shaped along that of the silicon substrate 30.

In the through-hole part 301, the wall electrode 32, focusing electrode 31, electron multiplier 33, and anode part 34 are arranged from one end side to the other end side. The wall electrode 32, focusing electrode 31, electron multiplier 33, and anode part 34 are formed by processing the silicon substrate 30 by RIE (Reactive Ion Etching) or the like and mainly composed of silicon.

The wall electrode 32 is a frame-shaped electrode formed so as to surround the photoelectric surface 41, which will be explained later, as seen in a direction confronting an opposing surface 40*a* of a glass substrate 40 which will be explained later (i.e., a direction substantially perpendicular to the opposing surface 40*a*). The focusing electrode 31, which is an electrode for focusing photoelectrons released from the photoelectric surface 41 and guiding them to the electron multiplier 33, is disposed between the photoelectric surface 41 and electron multiplier 33.

The electron multiplier 33 is constituted by N stages (N being an integer of 2 or greater) of dynodes (electron multiplier) set to different potentials along the electron multiplication direction from the photoelectric surface 41 to the anode part 34 and has a plurality of electron multiplication paths (electron multiplication channels) bridging the stages so as to extend in the electron multiplication direction. The anode part 34 is arranged at such a position that it and the photoelectric surface 41 hold the electron multiplier 33 therebetween.

The wall electrode 32, focusing electrode 31, electron multiplier 33, and anode part 34 are secured to the lower frame 4 by anode bonding, diffusion bonding, bonding with a sealant such as a low-melting metal (e.g., indium), and the like, so as to be arranged two-dimensionally on the lower frame 4.

The lower frame 4 is constructed from the rectangular planar glass substrate 40 serving as a base. The glass substrate 40 forms an opposite surface 40*a* made from glass, which is an insulating material, opposing the opposite surface 20*a* of the wiring board 20 and being an inner surface of the housing 5. The photoelectric surface 41, which is a transmissive photoelectric surface, is formed at an end part on the side opposite from the anode part 34 side in a portion on the opposite surface 40*a* opposing the through-hole part 301 of the side wall frame 3 (a portion other than the region bonded to the side wall part 302). A plurality of rectangular depressions 42 for preventing multiplied electrons from impinging on the opposite surface 40*a* are formed at portions on the opposite surface 40*a* where the electron multiplier 33 and anode part 34 are mounted. A plurality of stages of dynodes constituting the electron multiplier 33 and the anode 34 are arranged on middle parts 42*a* which are planar parts between the plurality of depressions 42.

The photomultiplier 1 of the photodetection part 110 is a planar photomultiplier having the electron multiplier 33 with a plurality of stages (N stages) as explained in the foregoing and is contained in a resin case 111 provided with a slit 111*a* in a region corresponding to the photoelectric surface 41 as illustrated in FIG. 1.

The photomultiplier 1 is also electrically connected to one end part 120*a* of the flexible wiring board 120. That is, the wiring of the flexible wiring board 120 is electrically connected to each of the conductive terminals 201A to 201D of the photomultiplier 1. For taking out an anode signal of the photomultiplier 1, a signal line 140 which is provided separately from the flexible wiring board 120 is used. A path for taking out the anode signal of the photomultiplier 1 may be contained in the flexible wiring board 120, so as to omit the signal line 140.

The other end part 120*b* of the flexible wiring board 120 is electrically connected to the voltage divider board 132 of the voltage divider 130.

The structure of the voltage divider 130 will now be explained with reference to FIG. 3.

Figure 3:
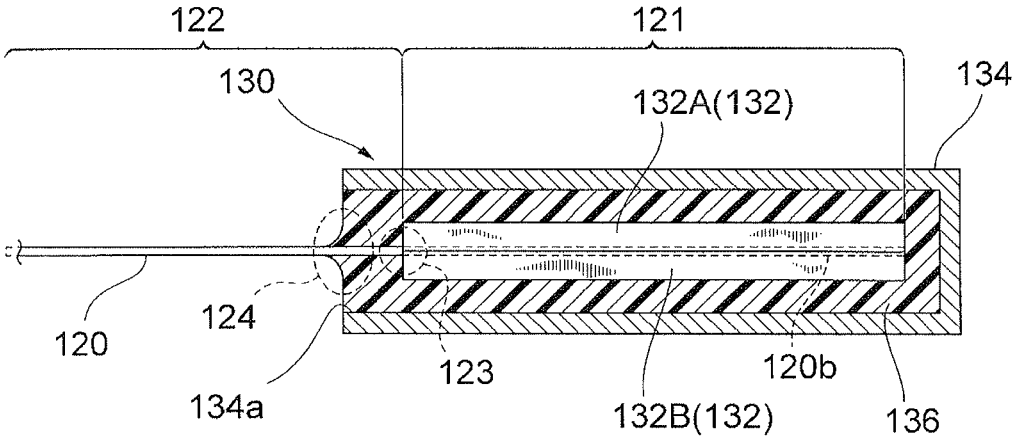
FIG. 3 is a sectional view of a voltage divider in the photodetection unit taken along the line III-III of FIG. 1.

As illustrated in FIG. 3, the voltage divider 130 comprises the voltage divider board 132, a resin case 134 containing the voltage divider board 132, and an insulating resin 136.

The voltage divider board 132 is constituted by first board 132A and second board 132B. The voltage divider board 132 and flexible wiring board 120 are joined to each other such that the end part 120*b* of the flexible wiring board 120 is held between the boards 132A, 132B.

Figure 4:
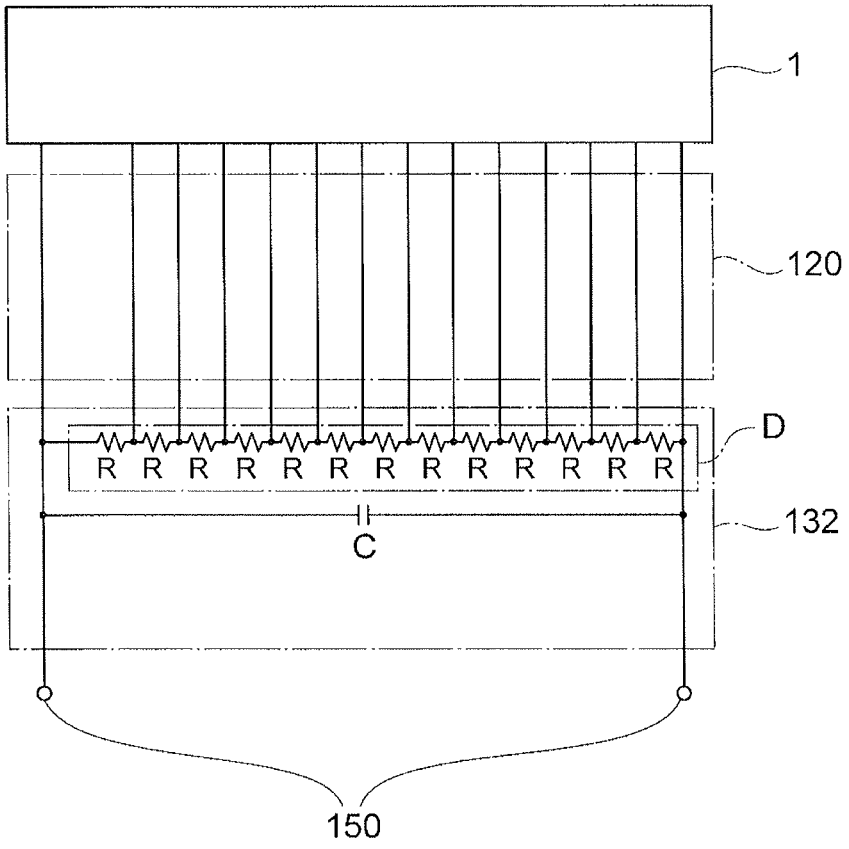
FIG. 4 is a schematic circuit diagram illustrating wiring in the photodetection unit of FIG. 1.

As illustrated in FIG. 4, a voltage divider circuit having a voltage divider element series D constituted by a plurality of voltage divider elements is formed on the voltage divider board 132. In the voltage divider circuit illustrated in FIG. 4, the voltage divider element series D is constituted by a plurality of resistance elements R connected in series and divides a high voltage applied through a high-voltage cable 150 to the voltage divider circuit, so as to generate voltages to be supplied to the respective stages of the electron multiplier 33 in the photomultiplier 1. The generated voltages are supplied to the photomultiplier 1 through the flexible wiring board 120.

As illustrated in FIG. 4, the voltage divider circuit of the voltage divider board 132 has not only the voltage divider element series D, but also a capacitor C connected in parallel to the voltage divider element series D. The voltage divider circuit functions without the capacitor C but can use thus connected capacitor C as a noise return path when the high-voltage cable 150 carries noise, thereby preventing the noise from affecting the photomultiplier 1 through the flexible wiring board 120. As the capacitor C, a ceramic capacitor, which has a high voltage withstand performance and a small size, can be employed. The voltage divider circuit is not limited to the one mentioned above, but can be changed as appropriate in view of the efficiency of collecting photoelectrons released from the photoelectric surface 41 of the photomultiplier 1 and the gain and pulse linearity characteristic in the electron multiplier 33.

The resin case 134, which is a rectangular parallelepiped case having such a size as to cover the voltage divider board 132 as a whole, is constituted by an insulating resin, an example of which is an ABS resin. One end face of the resin case 134 is opened, so as to provide an opening 134*a* for passing the flexible wiring board 120 therethrough.

The insulating resin 136, which is constituted by a silicone resin, for example, is formed so as to fill a space between the resin case 134 and voltage divider board 132. That is, the insulating resin 136 completely covers around the voltage divider board 132 within the resin case 134. The insulating resin 136 covering the voltage divider board 132 is required to have at least voltage withstand performance (high insulation), flame retardance (prevention of ignition due to heating), and low water absorption (prevention of elements and resins from deteriorating due to moisture infiltration) and also high fluidity in the uncured state in order to securely cover around the voltage divider board 132 in a manufacturing procedure which will be explained later. The insulating resin 136 is not limited to the silicone resin, but may be a urethane resin, an epoxy resin, or the like as long as it is a resin having the characteristics mentioned above.

The voltage divider 130 explained in the foregoing can be produced by the following procedure.

Figure 5:
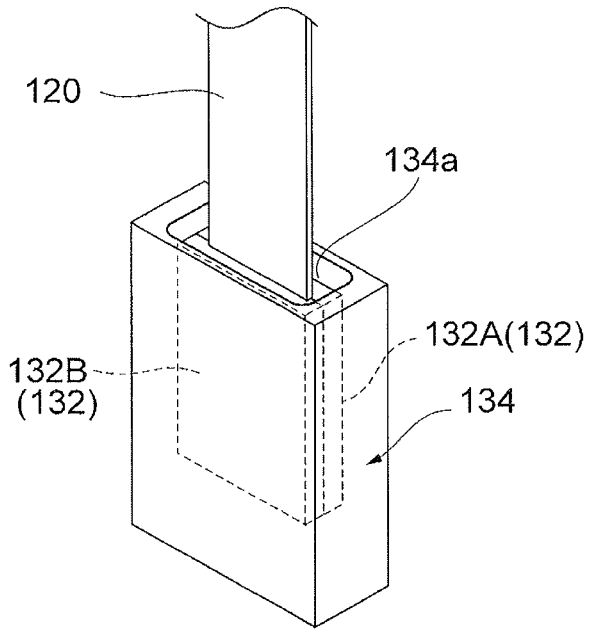
FIG. 5 is a diagram illustrating a step of producing the photodetection unit of FIG. 1.

First, the photomultiplier 1 is electrically connected to one end part 120*a* of the flexible wiring board 120, and the voltage divider board 132 is electrically connected to the other end part 120*b* of the flexible wiring board 120. Subsequently, as illustrated in FIG. 5, the voltage divider board 132 (132A, 132B) having the flexible wiring board 120 connected thereto is directed downward and completely contained in the resin case 134 without coming into contact with the inner wall of the resin case 134, and then an uncured insulating resin to become the insulating resin 136 is injected from the opening 134*a* such that the voltage divider board 132 is completely embedded therein. As a result, the surroundings of the voltage divider board 132 are completely covered with the uncured insulating resin within the resin case 134. Thereafter, the uncured insulating resin is cured by a predetermined method, whereby the voltage divider board 132 is completely covered with the cured insulating resin 136. The uncured insulating resin may be injected into the resin case 134 not only from the opening 134*a* but also from opening parts different from the opening 134*a*.

The uncured insulating resin to become the insulating resin 136 may be injected into the resin case 134 from the opening 134*a* before the voltage divider board 132 is completely contained in the resin case 134, so as to cover the surroundings of the voltage divider board 132 completely with the uncured insulating resin within the resin case 134. The voltage divider board 132 may be placed in the state not in contact with the inner wall of the resin case 134 before the uncured insulating resin cures after injection.

In the photodetection unit 100 explained in the foregoing, the photomultiplier 1 and voltage divider board 132 are electrically connected to each other through the flexible wiring board 120. Therefore, within permissible ranges of flexibility and length of the flexible wiring board 120, the orientation of the photomultiplier 1 and its relative position with respect to the voltage divider board 132 can be set freely. Specifically, without being restricted to the state of arrangement of the voltage divider board 132 and the like, the target direction of the photoelectric surface 41 of the photomultiplier 1 (photodetection direction) can be oriented to a desirable direction, and the photoelectric surface 41 may be arranged on a plane different from that of the voltage divider board 132 of the photomultiplier 1. Therefore, the photodetection part 110 including the photomultiplier 1 has a high degree of freedom of installation.

In addition, the insulating resin 136 within the resin case 134 covers around the voltage divider board 132, thereby improving the voltage withstand performance of the voltage divider board 132. Additionally, by further shrouding the insulating resin 136 that covers the voltage divider board 132 with the insulating resin case 134, the voltage withstand performance is further improved, and, additionally shock resistance, environmental stability, and ease of handling are also improved. This eases restrictions on conditions under which the voltage divider board is installed, whereby the degree of freedom of installation of the photodetection unit is further improved as a whole, which makes it applicable to wider uses.

The space between the resin case 134 and voltage divider board 132 is completely filled with the insulating resin 136 in the resin case 134 in the above-mentioned embodiment in particular.

When the ABS resin constituting the resin case 134 and the silicone resin constituting the insulating resin 136 are compared with each other in terms of insulation (dielectric breakdown voltage), the silicone resin has a higher dielectric breakdown voltage, which is about 27 kV, than that of the ABS resin, which is about 14 to 20 kV.

Therefore, a mode in which the space between the resin case 134 and voltage divider board 132 is filled with the insulating resin 136 such that the voltage divider board 132 is completely covered with the insulating resin 136 around can achieve a higher voltage withstand performance than a mode in which the voltage divider board 132 is in contact with the resin case 134.

When the ABS resin constituting the resin case 134 and the silicone resin constituting the insulating resin 136 are compared with each other in terms of heat dissipation (thermal conductivity), the silicone resin has a higher coefficient of thermal conductivity, which is about 0.5 W/m·k, than that of the ABS resin, which is about 0.2 to 0.3 W/m·k.

Therefore, the insulating resin 136 completely covering around the voltage divider board 132 can conduct heat generated in the voltage divider board 132, whereby the heat is rapidly released from the opening 134*a* to the outside of the resin case 134.

As illustrated in FIG. 3, in the flexible wiring board 120, a boundary part 123 between a part 121 in contact with the voltage divider board 132 and a part 122 separated therefrom is covered with the insulating resin 136. Therefore, when an external force is exerted on the boundary part 123 of the flexible wiring board 120 in such a direction as to bend it, the resulting bending stress is mitigated by the insulating resin 136. That is, the insulating resin 136 makes it harder for excessive bending stresses to be exerted on the boundary part 123 of the flexible wiring board 120. This effectively prevents from breaking of wires in the boundary part 123 of the flexible wiring board 120.

In addition, the insulating resin 136 within the resin case 134 covers the whole periphery of the flexible wiring board 120 at the opening 134*a*. When the whole periphery of the flexible wiring board 120 at the opening 134*a* is not covered with the insulating resin 136, the flexible wiring board 120 may come into contact with the resin case 134 at the position of the opening 134*a*, thereby causing a contact stress, which may break wires in the flexible wiring board 120 in some cases. In the above-mentioned embodiment, by contrast, the whole periphery of the flexible wiring board 120 is covered with the insulating resin 136 at the opening 134*a*, so as to prevent the flexible wiring board 120 from coming into contact with the resin case 134, which makes it hard for wires to break as mentioned above.

In a boundary part 124 where the flexible wiring board 120 projects from the insulating resin 136 within the opening 134*a*, the insulating resin 136 is formed in such a state as to ascend along the flexible wiring board 120. The ascended part supports the region of the boundary part 124 of the flexible wiring board 120, thereby further preventing the flexible wiring board 120 from coming into contact with the resin case 134.

The silicone resin or the like constituting the insulating resin 136 can elastically deform to some extent and thus functions to absorb vibration. Therefore, even when the photodetection unit 100 is installed in an environment where the voltage divider 130 vibrates, the vibration is suppressed by the insulating resin 136, so as to be less likely to reach the voltage divider board 132. When the voltage divider circuit of the voltage divider board 132 has the capacitor C as illustrated in FIG. 4 in particular, microcracks may occur in the capacitor C and deteriorate its functions due to vibration or shock. In the above-mentioned embodiment, the insulating resin 136 covers around the voltage divider board 132, so that the voltage divider board 132 improves its resistance to vibration and shock, thereby preventing microcracks from deteriorating functions of the capacitor C even when the voltage divider circuit including the capacitor C is formed on the voltage divider board 132.

The present invention can be modified in various ways without being restricted to the above-mentioned embodiment. For example, the voltage divider board, which is illustrated as one constituted by two boards, can be changed to a mode constituted by a single board or three or more boards as appropriate. As the photomultiplier, various planar photomultipliers can be employed without being restricted to the one constructed as illustrated in FIG. 2.

REFERENCE SIGNS LIST

1 photomultiplier
33 electron multiplier

100 photodetection unit
110 photodetection part
120 flexible wiring board
130 voltage divider
132 voltage divider board
134 resin case
136 insulating resin

The invention claimed is:

1. A photodetection unit comprising:

a planar photomultiplier having an electron multiplier with a plurality of stages;

a voltage divider board for generating voltages to be supplied to the respective stages of the electron multiplier; and a flexible wiring board having one end part electrically connected to the photomultiplier and the other end part electrically connected to the voltage divider board;

the photodetection unit further comprising:

a resin case for containing the voltage divider board; and an insulating resin for covering around the voltage divider board within the resin case.

2. A photodetection unit according to claim 1, wherein a space between the resin case and the voltage divider board within the resin case is filled with the insulating resin.

3. A photodetection unit according to claim 1, wherein a boundary part between a part in contact with the voltage divider board and a part separated from the voltage divider board is covered with the insulating resin.

4. A photodetection unit according to claim 1, wherein the resin case has an opening for passing the flexible wiring board therethrough; and wherein the insulating resin within the resin case covers the flexible wiring board at the opening.

5. A photodetection unit according to claim 1, wherein the voltage divider board includes a capacitor.

6. A method for manufacturing a photodetection unit comprising a planar photomultiplier having an electron multiplier with a plurality of stages and a voltage divider board for generating voltages to be supplied to the respective stages of the electron multiplier, the method comprising the steps of:

electrically connecting the photomultiplier to one end part of a flexible wiring board;

electrically connecting the voltage divider board to the other end part of the flexible wiring board;

containing the voltage divider board electrically connected to the flexible wiring board in a resin case and covering the voltage divider board with an uncured insulating resin within the resin case; and curing the uncured insulating resin within the resin case.

* * * * *